US005718420A

United States Patent [19]

Bernstein

[11] Patent Number: 5,718,420

[45] Date of Patent: Feb. 17, 1998

[54] WORKHOLDING WEDGE CLAMP

[75] Inventor: Leon M. Bernstein, Minnetonka, Minn.

[73] Assignee: Kurt Manufacturing Company, Inc., Fridley, Minn.

[21] Appl. No.: 678,112

[22] Filed: Jul. 11, 1996

Related U.S. Application Data

[63] Continuation of Ser. No. 426,565, Apr. 21, 1995, abandoned.

[51] Int. Cl.[6] ..... B25B 1/00

[52] U.S. Cl. ..... 269/138; 269/153; 269/234; 269/157; 269/224

[58] Field of Search ..... 269/99, 100, 153, 269/224, 234, 157, 254 R, 303, 305, 315, 317, 136, 138, 137

[56] References Cited

U.S. PATENT DOCUMENTS

| | | | |
|---|---|---|---|
| 1,457,307 | 6/1923 | Kerns | 269/136 |
| 2,580,585 | 1/1952 | Odin . | |
| 2,992,665 | 7/1961 | Mertz . | |
| 4,365,792 | 12/1982 | Johns | 269/224 |
| 4,489,927 | 12/1984 | Yamada et al. | 269/137 |
| 4,562,999 | 1/1986 | Ryser | 269/137 |
| 4,643,411 | 2/1987 | Izumi | 269/99 |
| 4,736,935 | 4/1988 | Vasapolli | 269/137 |
| 4,793,603 | 12/1988 | Wober et al. | 269/317 |
| 4,804,171 | 2/1989 | Dornfeld . | |
| 4,805,888 | 2/1989 | Bishop | 269/99 |
| 4,958,818 | 9/1990 | Buchter | 269/136 |
| 5,056,766 | 10/1991 | Engibarov | 269/136 |

FOREIGN PATENT DOCUMENTS

| | | | |
|---|---|---|---|
| 2124129 | 2/1984 | United Kingdom | 269/317 |

*Primary Examiner*—Robert C. Watson

*Attorney, Agent, or Firm*—Westman, Champlin & Kelly, P.A.

[57] ABSTRACT

A wedge workholding clamp has a clamp body that is adapted for mounting onto a table and is used for holding various objects, and specifically for holding piece parts in machining. The clamp body slidably mounts a movable jaw that is actuated with a wedge using a clamping screw. When a single jaw is actuated, the clamp body has one reaction surface that is square with the direction of clamping and parallel to the axis of the screw. The wedge has an end surface that engages and moves along the reaction surface of the clamp body as the wedge is tightened so there are no bending loads on the screw. The wedge also has a wedge surface that engages a surface of the movable jaw and which acts to move the movable jaw from a released position to a position clamping a workpiece. The clamp body carries a resiliently movable pin projecting into a receptacle in the movable jaw to provide a spring force tending to move the movable jaw and wedge to the released position, and to retain the movable jaw in position on the clamp body during normal operations. The movable jaw and wedge have guide flanges or mating slot walls to guide the movable jaw and wedge and protect the work holding clamp from chips.

21 Claims, 8 Drawing Sheets

WORKHOLDING WEDGE CLAMP

This is a continuation of application Ser. No. 08/426,565, filed Apr. 21, 1995 now abandoned. Priority of the prior application is claimed pursuant to 35 USC § 120.

BACKGROUND OF THE INVENTION

The present invention relates to a compact workholding wedge clamp that will lock workpieces into position on a tool table or workholder for machining centers, vises and other machine tools.

Various types of compact workholding clamps have been advanced for workholding systems where a multiple number of parts are mounted onto a table or pallet using wedge clamping principals. An example of a clamp that uses a wedge is shown in U.S. Pat. No. 4,804,171. The wedge is pressed against opposite sides of a "U-shaped" frame or holder, to provide a lateral clamping force to clamp a part against a fixed support or jaw. Self-contained wedge type clamps or vises are used for various applications. In existing clamps, if the movable jaw is loose, it can become separated from the other parts of the clamp when the clamp is released. If the jaws are held together, the retaining systems used tend to limit the adaptability of the clamping action.

A clamping device sold by "Tecnara" under the trademark IZUMI "Dependvises" has a dual-wedge clamping mechanism. This device provide a downward force on the movable jaw, as is desirable, to keep the movable jaw and workpiece securely held when clamped. However, the movable jaw is not retained in place without an additional retractable device, and when the clamp is loosened and the workpiece removed, the movable jaw can become separated from the clamp body.

SUMMARY OF THE INVENTION

The present invention relates to a locking wedge operated clamp that utilizes a wedge for urging a movable jaw against a workpiece. The movable jaw is maintained in a usable position on a clamp base when the clamping jaws are released. A post is mounted on the clamp base for each movable jaw in a resilient, elastomeric material and a port end protrudes into a recess in the movable jaw. When the jaw is unclamped, the lock wedge overlies a surface of the movable jaw to prevent the movable jaw from coming off the post. When clamping forces are applied by using the lock wedge, the movable jaw will slide on the clamp base and the post will shift in position as it compresses the elastomeric mounting material. This provides a controlled spring force tending to open the movable jaw when it is released. The spring force keeps the lock wedge surface in contact with the mating surface of the movable jaw and prevents penetration of chips into the contact area. The lock wedge also provides for a downward force component on the movable jaw to urge the jaw against the clamp base for desired clamping action.

The sliding or mating surfaces between the lock wedge and movable jaw, and the base are shielded from chips in use and since this assembly is maintained when the lock wedge is released, the movable jaw does not become accidentally separated from the clamp base. However, one movable jaw can be quickly intentionally removed to permit different movable jaws to be utilized interchangeably.

Various configurations of the movable jaw face can be provided for different clamping jobs. The movable jaws can be made with stepped clamping surfaces or they can be V-shaped, with the "V" extending horizontally or vertically. A soft aluminum jaw face can be provided, to permit custom machining part contacting surfaces as is now done for CNC machines. Serrated jaws can be used. There are no holes in the jaw faces, which is particularly important with small clamps.

The mounting of the post that retains the movable jaw and acts as a spring keeps the wedge surface or surfaces in contact with the mating surfaces of the movable jaw as the wedge is retracted to provide protection from chips getting between those surfaces. In one preferred embodiment the movable wedge and the jaw both have two side guide and chip guard flanges that guide the wedge and the movable jaw properly during movement and which exclude chips from entering the area under the wedge to keep this area clean also. The flanges on the movable jaw and wedge protect the jaw supporting surface of the clamp base from chips.

The movable jaw is thus a quick change jaw. When it is desired to remove the movable jaw, the wedge can be loosened sufficiently to permit lifting the movable jaw off the mounting post, and a new jaw may be put in use. The rapid change feature is available with the present invention, while the advantages of adequate clamping, chip protection and spring return are still available.

In a preferred form of multiple clamp assembly disclosed, a serrated clip is used for a fixed jaw to provide securely holding a fixed jaw on the table and yet permit adjustment for clamping.

When a wedge having a single wedge surface is used the clamp body is provided with a reaction surface parallel to an actuating screw used for operating the wedge. The wedge has an end surface parallel to the actuating screw that slides against the clamp body reaction surface. Thus the wedge moves parallel to the axis of the screw and the actuating screw is not bent.

The clamp as shown can use a double face wedge to activate movable jaws positioned on both sides of the wedge. In the double wedge form of the invention, the wedge will "float" so that it will self-center and will not bend the bolt that is used for clamping or activating the wedge.

The wedge clamp is small, low cost, and has a very low profile that does not interfere with machining operations.

The wedge clamp is capable of being used for many different clamping operations and as shown, the wedge clamp can be used on a pallet that has nests for holding custom parts for carving the pallet itself from the clamp body and mounts the resiliently loaded pins for keeping a pretension on the movable jaw. The movable jaw can have a face formed or machined to fit the workpiece being held.

DETAILED DESCRIPTION OF THE PREFERRED EMBODIMENTS

Figure 1:
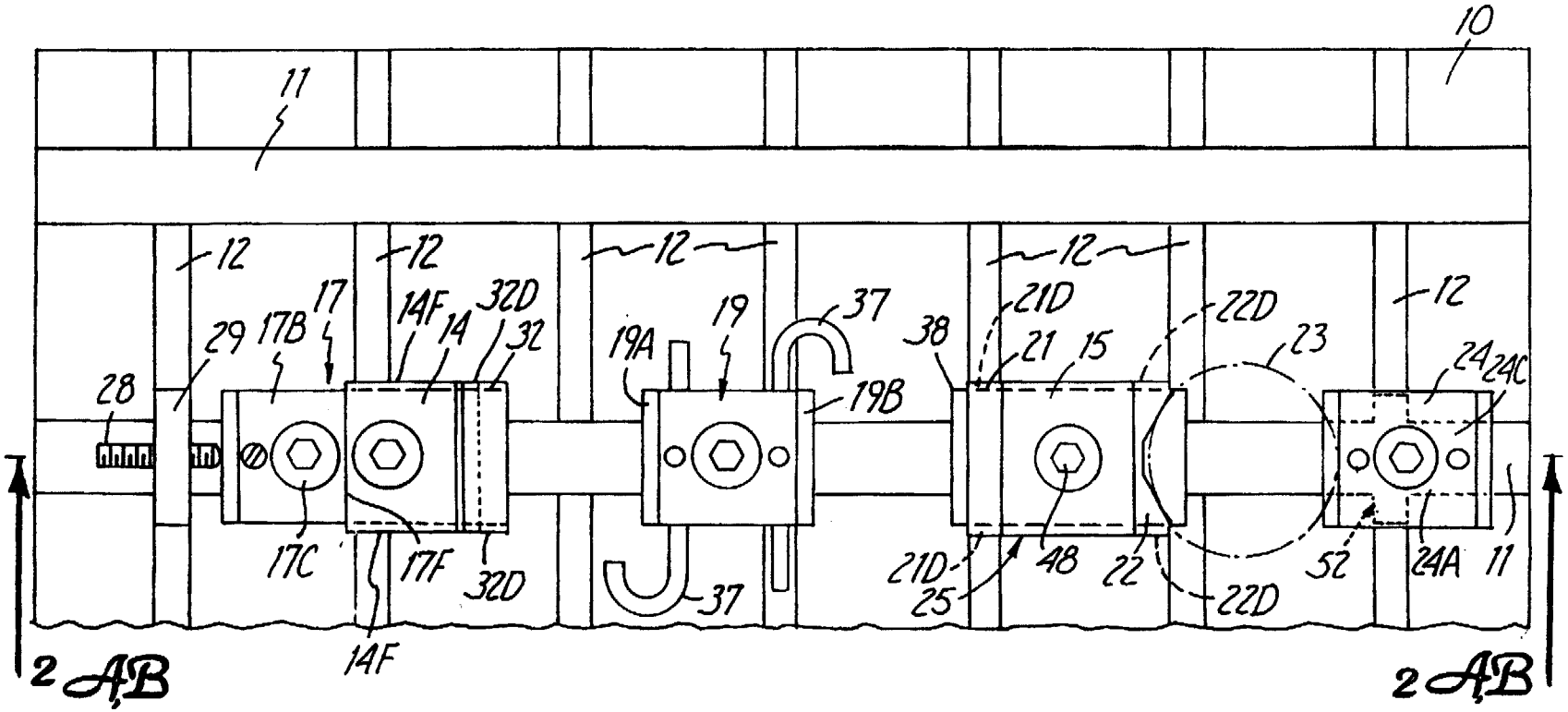
FIG. 1 is a top plan view of a typical tool plate having a series of wedge clamps made according to the present invention installed thereon.
Figure 2A:
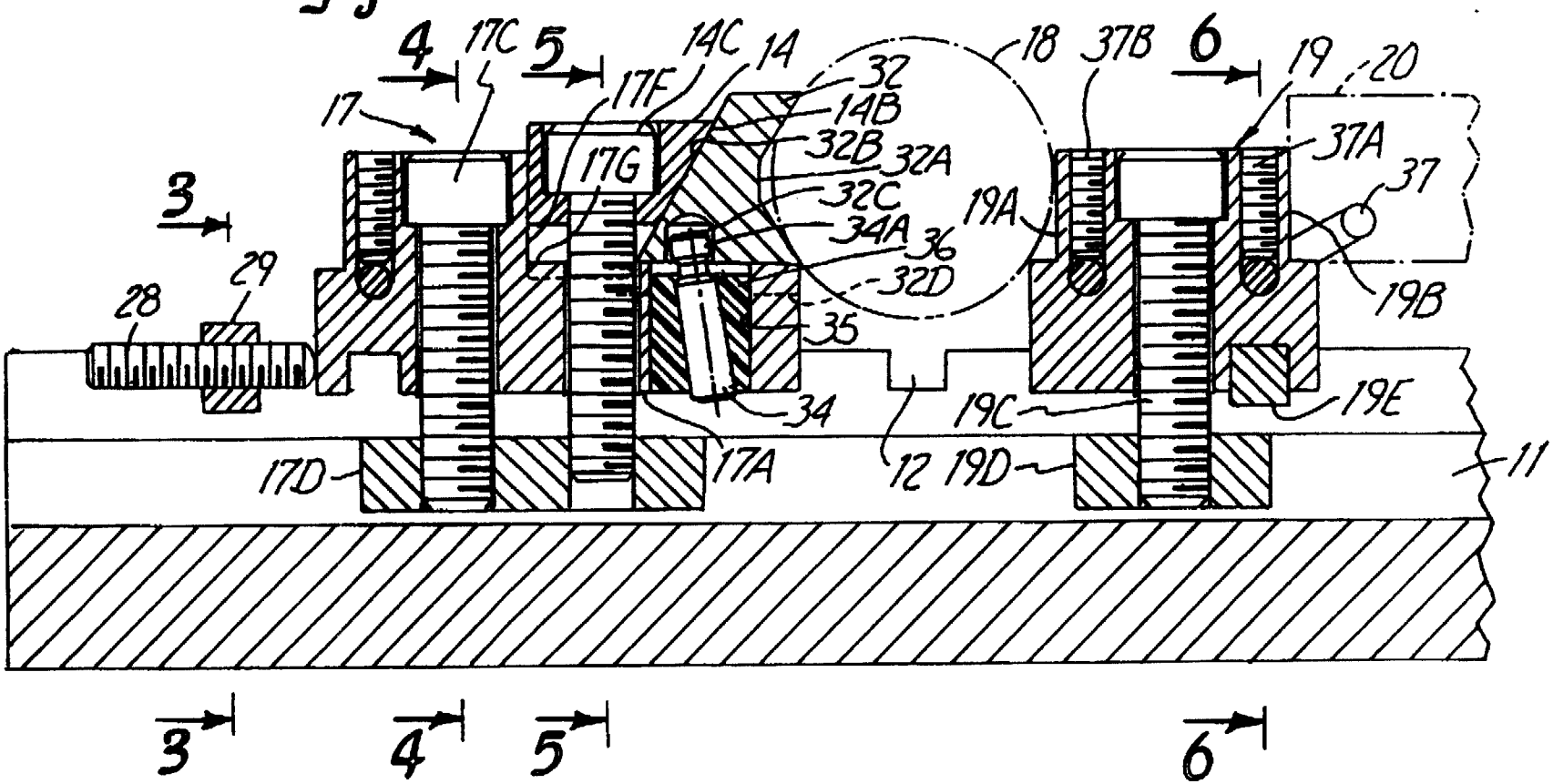
FIGS. 2A and 2B together comprise a sectional view taken as on line 2—2 in FIG. 1.
Figure 2B:
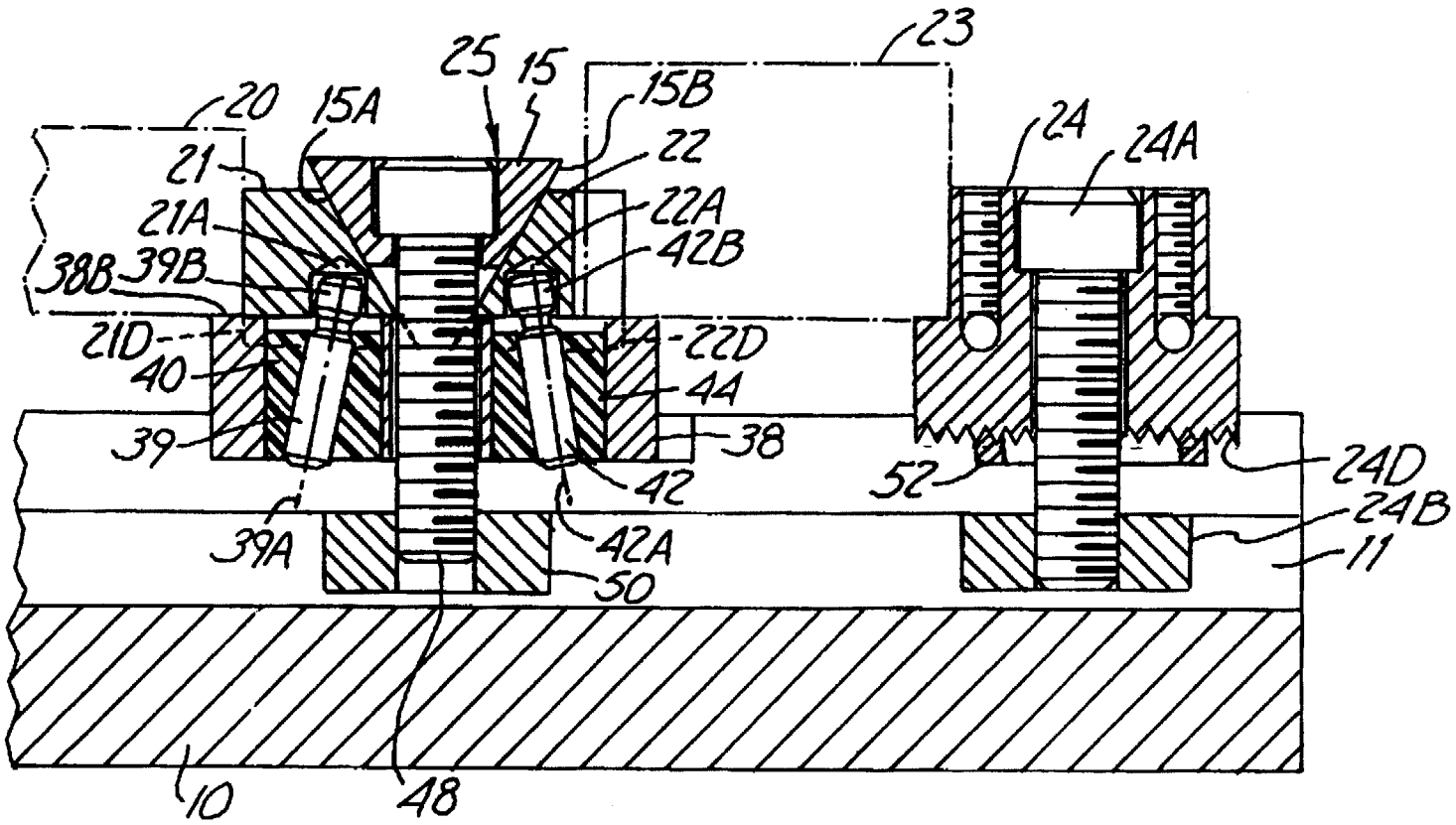

Referring to FIGS. 1 and 2 in particular, as well as the cross sections shown in FIGS. 3–8, a tool table, pallet or similar support shown generally at 10 has T-slots 11, extending in a first direction, and cross slots of shallower depth shown at 12. The cross slots 12 are positioned at regularly spaced intervals along the length of the T-slots in the table or pallet. A single jaw lock wedge 14, and a double jaw lock wedge 15 are shown on the table 10. The jaw wedges are placed in clamp assemblies mounted in series, as shown, on the table 10 along one of the T-slots 11 to provide for clamping a plurality of workpieces (as shown 3 workpieces—See FIGS. 2A and 2B).

A first clamp assembly 17 is provided at one end of the T-slot 11 of table 10, and includes the single jaw lock wedge 14 that is used to clamp a workpiece 18 against a jaw 19A of a first fixed jaw assembly 19. The fixed jaw assembly 19 has an oppositely facing fixed jaw 19B. A workpiece 20 is clamped between the jaw 19B and a movable jaw at 21 on one side of the double jaw lock wedge 15, which is part of a second clamping assembly 25. Jaw 19B is on an opposite side of the fixed jaw assembly 19 from jaw 19A which clamps workpiece 18. The second movable jaw 22 activated by the double jaw lock wedge 15 engages a workpiece 23 that is supported against an end fixed jaw 24. In the series of clamps, it can be seen that the reaction forces of the jaw lock wedges will be taken up by fixed jaws that are held in a suitable manner in the T-slots of table 10.

The first clamp assembly 17 has a clamp body 17A that is made to accommodate the single jaw lock wedge 14 at one end thereof. The clamp body 17A includes a reaction column or neck 17B through which a cap screw 17C extends.

Figures 3, 4, 5, 6:
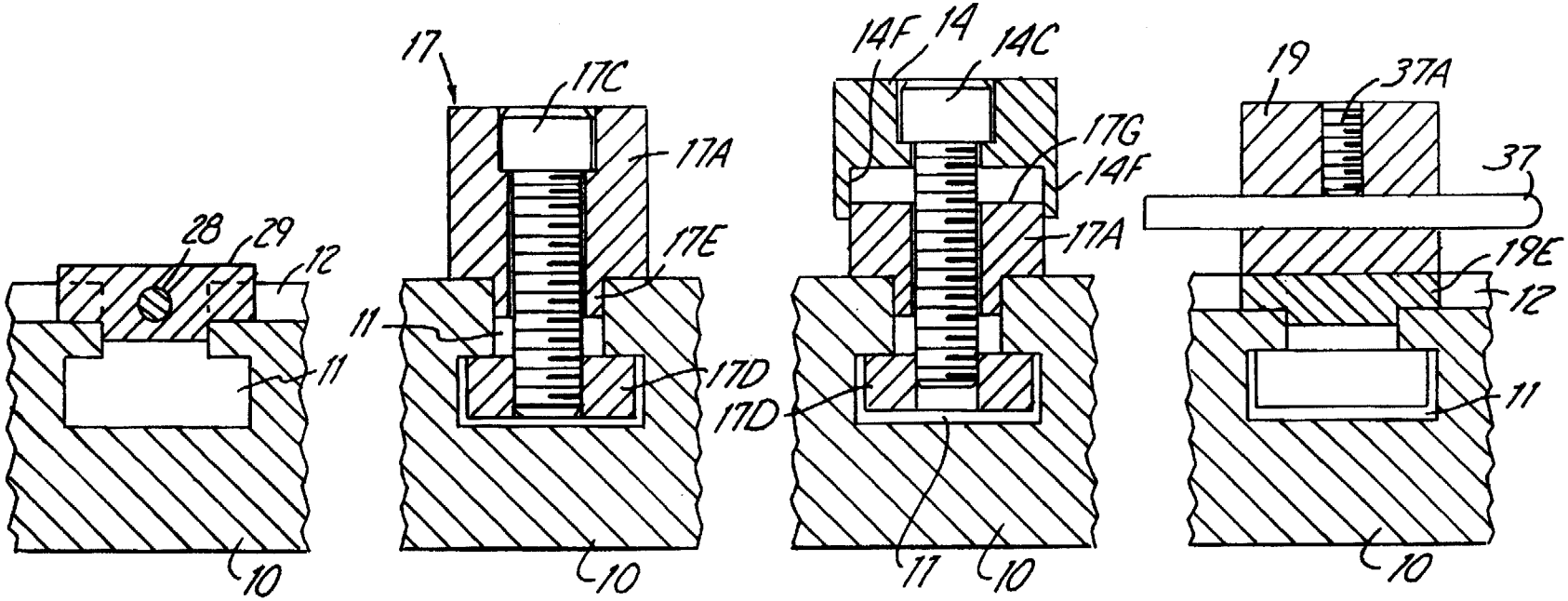
FIG. 3 is a sectional view taken as on line 3—3 in FIG. 2.
FIG. 4 is a sectional view taken as on line 4—4 in FIG. 2.
FIG. 5 is a sectional view taken as on line 5—5 in FIG. 2.
FIG. 6 is a sectional view taken as on line 6—6 in FIG. 2.
Figure 8:
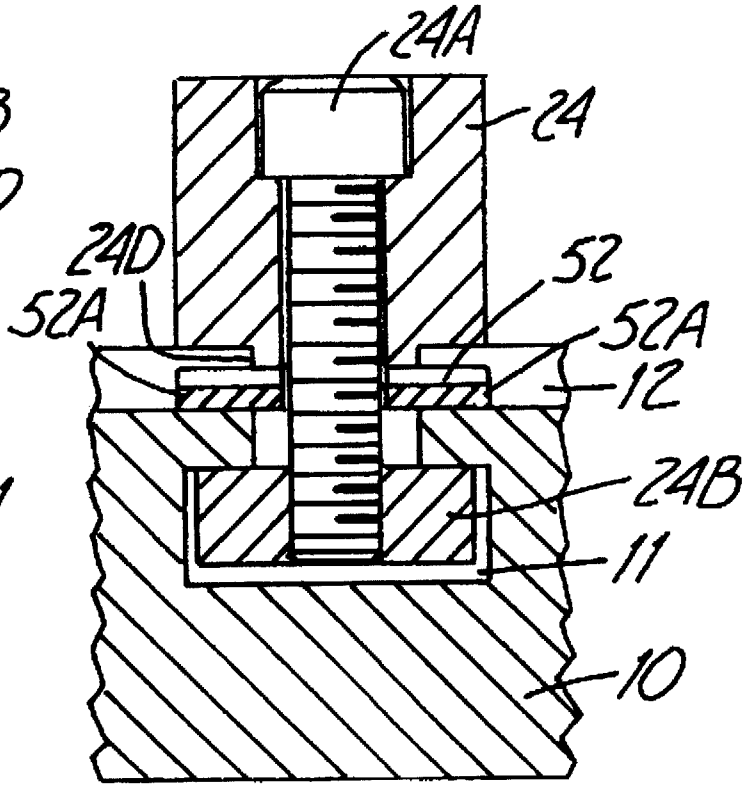
FIG. 8 is a sectional view taken as on line 8—8 in FIG. 2.
Figure 7:
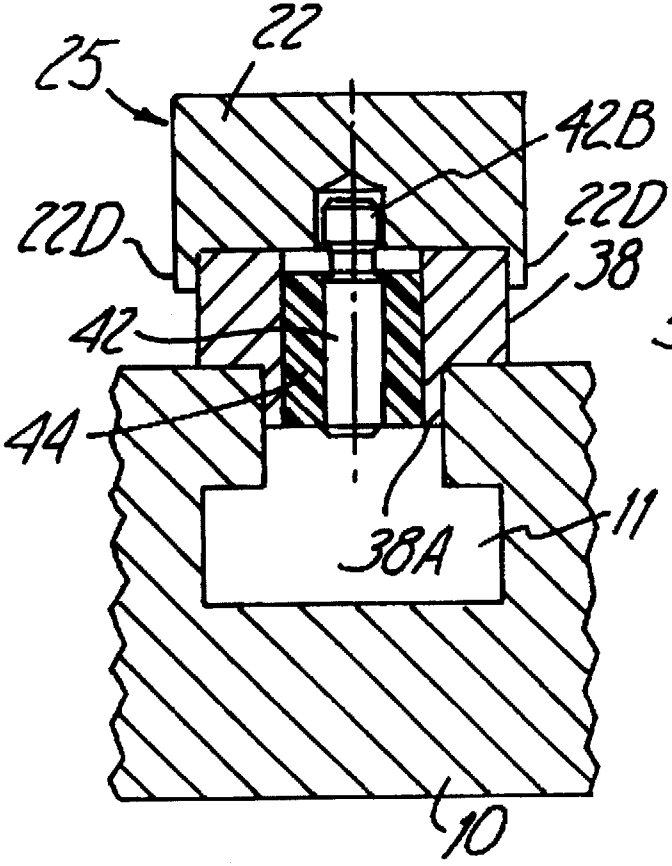
FIG. 7 is a sectional view taken as on line 7—7 in FIG. 2.

The cap screw 17C threads through a retainer nut 17D that is positioned under the overhanging ledges of the T-slot 11, as shown in FIG. 4. As also shown in FIG. 4, the clamp body 17A has a elongated neck portion 17E that fits into the opening of the T-slot between the overhanging shoulders to provide for a snug fit in the slot to reduce side to side movement of the clamp body 17A.

In addition to being clampable with the cap screw 17C, the clamp body is supported from movement along the slot from clamping forces by a cross lug 29 that fits into one of the cross slots 12, as shown. Adjusting an adjustment screw 28 that threads through lug 29 and bears against clamp body 17A will permit a fine adjustment of the position of the clamp body 17A.

The clamp body column or block 17B forms a shoulder surface 17F, at one end of an upwardly facing support surface 17G. The surface 17G is used for a mounting surface for the jaw activated by single jaw lock wedge 14.

As shown, the lock wedge 14 has a single wedge surface 14B that is inclined from a plane perpendicular to the table 10 and which faces toward the workpiece 18 and also faces downwardly toward the surface 17G and the surface of the table 10. The lock wedge 14 is adjusted as to its position relative to the surface 17G with a cap screw 14C that passes through the clamp body and threads into an opening in the retainer nut 17D. By adjusting the screw 14C, the vertical position of the lock wedge 14 and this wedge surface 14B can be changed to provide a lock action.

A movable clamp jaw 32 is slidably supported on the surface 17G of the clamp body 17A, and has a jaw face 32A that is configured so that it will engage and hold a cylindrical workpiece 18 with the axis of the cylindrical workpiece 18 being parallel to the transverse dimension of the clamp jaw 32. The clamp jaw 32 has a wedge follower surface 32B, which is inclined from a plan perpendicular to table 10, to slidably mate with the lock wedge surface 14B. The lock wedge surface and the wedge follower surface are both inclined relative to a plane parallel to the direction of movement of the wedge and perpendicular to the direction of movement of the movable jaw. The bottom surface of the clamp jaw 32 slides on the surface 17G. A cylindrical recess or bore 32C is formed in the underside of clamp jaw 32.

The clamp body 17A has a bore 35 located on surface 17G at a location underneath the clamp jaw 32. A pin 34 is molded into a cylinder of elastomeric material 36 which forms an elastomeric spring for the properly oriented pin 34. The insert can be slipped into place in bore 35. The pin 34 has a head 34A that protrudes into the recess 32C, and as shown the edges of the head 34A are chamfered or rounded so that there can be angular movement of the pin 34 relative to the axis of the recess 32C. The elastomeric material 36 provides a resilient mounting or spring support for the pin 34, so that the angle of the axis 34B of the pin 34 can be changed by resiliently compressing the elastomeric material.

As shown, when initially positioned, at a wedge rest or free position, the axis 34B of pin 34 is inclined in a first direction toward the lock wedge 14, and in direction away from the jaw face. The lock wedge 14 is moved downwardly parallel to guiding surface 17F by tightening the cap screw 14C without bending, along an axis perpendicular to surface 17G. The lock wedge 14 moves the clamp jaw 32 in a lateral direction toward the workpiece 18. The pin 34 resiliently loads the clamp jaw 32 against surface 14B throughout movement of the wedge by compressing the elastomeric material mounting 36. The axis 34B of the pin 34 will change inclination and will incline an equal amount in opposite direction from that shown in FIG. 2A when in a full tightened position.

Figure 11:
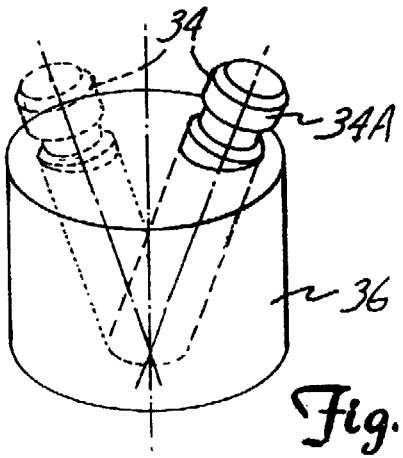
FIG. 11 is a schematic perspective view of a typical elastomerically mounted pin for holding a preload on the movable jaw.

In FIG. 11 the elastomeric material 36 is shown separately with the pin 34 in place. The pin 34 moves from a "free" or rest position illustrated in dashed lines to a full compression position shown in solid lines. The stroke length of the spring action is illustrated by the two positions of the pin 34 in FIG. 11. The cylinder of elastomeric material 36 can be varied in height along the pin to provide different spring action. The axis 34B of pin 34 can move and incline in an opposite direction from a vertical plane by an amount needed to accommodate the movement. The column or neck 17B reacts the clamping loads through surface 17F. The elastomeric spring provides a long stroke, and the preload of the mating wedge surfaces provides chip protection. The elastomeric material 36 and pin 34 are a separate unit to provide the ability to change spring rates and operating range.

It can be seen that the end of the clamp body 17A having support surface 17G is made to mate with the under surface of the jaw 32 to provide a sliding guide for the jaw 32 as it is moved by adjusting the lock wedge 14 for clamping. The lock wedge 14 has side flanges 14F that slide along the sides of body 17A, and the jaw 32 also has side flanges 32D that slide along the sides of clamp body 17A. The flanges prevent chips from falling on surface 17G.

The workpiece 18 is supported on its opposite side from the movable jaw 32 on the jaw face 19A of the fixed jaw assembly 19. The fixed jaw assembly 19 is held in the T-slot 11 with a cap screw 19C threaded into a locknut or plate 19D held under the overhanging shoulders of the T-slot in a normal manner, as also shown in FIG. 5. Also, the fixed jaw is locked relative to the table 10 with a key 19E that fits into a slot in the jaw assembly 19 and in a cross slot 12 that is positioned under the fixed jaw assembly 19.

The fixed jaw assembly 19 has workpiece stops or locators 37, held in bores that extend across the fixed jaw. The stops 37 are locked in place with suitable lock screws 37A and 37B. The stops can be adjusted for providing stops for the workpiece 18, and also for the workpiece 20 that is held against the jaw face 19B.

The double jaw lock wedge 15 is on an opposite side of the workpiece 20 from the fixed jaw 19 on a double clamp assembly 25. The clamp assembly 25 includes a clamp body 38, that has a reduced width section 38A (FIG. 7) that fits between the shoulders of the T-slot 11 in which the lock wedge 15 is mounted. The clamp body 38 rests on the top of the table 10 as shown. The movable jaws 21 and 22 slidably engage an upper surface 38B of the clamp body 38. In this form of the invention, the clamp body 38 is provided with two bores or openings therethrough, each of which is used to mount an elastomeric spring and pin for retaining the respective one of the movable jaws 21 and 22. As shown, an elastomeric material insert 40 holding a pin 39 is mounted in a bore on the side of the clamp body 38 adjacent the workpiece 20. The elastomeric material 40 that can be molded in place around the pin 39 and then inserted in a bore in the clamp body 38.

On the end of the clamp body 38 adjacent the workpiece 23, a pin 42 is held in a bore in the clamp body 38 with elastomeric material 44 molded or formed in place around the pin. Pins 39 and 42, as shown, have axes 39A and 42A, respectively, that are inclined toward the center of the body 38, and thus toward lock wedge 15 that has double wedge surfaces 15A and 15B, respectively. Surfaces 15A and 15B engage inclined surfaces 21B and 22B of the movable jaws 21 and 22, respectively, as shown.

The movable jaws 21 and 22 each have a recess or bore 21A and 22A, respectively, to slidably receive heads 39B and 42B of the respective pins 39 and 42. The heads 39B and 42B are chamfered or rounded so that the angular position of the axes 39A and 42A of the pins relative to the axes of the bores 21A and 22A can change as the movable jaws 21 and 22 are operated.

The double faced lock wedge 15, as shown, and is operated by tightening a cap screw 48 that passes through a bore in the body 38 and which threads into a locknut plate 50 in the T-slot. By tightening the cap screw 48, the lock wedge 15 can be moved down and the surface 15A and 15B will act on surfaces 21B and 22B to urge the movable jaws 21 and 22 outwardly from the center. The lock wedge self positions itself and body 38 as the screw 48 is tightened, since body 38 can slide until the lock nut tightens securely. The nut 50 and body 38 thus slide or move along the T-slot to equally clamp both parts of various sizes, within tolerance. The clamp tightens in the T-slot and clamps the workpieces 20 and 23 as the clamp body 38 centers. The elastomeric material 40 and 44 holding pins 39 and 42 will compress, and act as springs on the pins to return the movable jaws to an unclamped position. The workpiece 23 is a cylindrical block that fits into a V configuration formed on the face 22C of the movable jaw 22.

Figure 10:
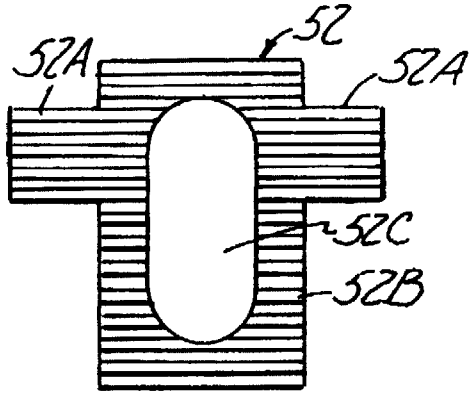
FIG. 10 is a plan view of a serrated lock utilized with an end fixed jaw in FIG. 2.

The fixed jaw 24 is held in place with a cap screw 24A that threads into a locknut 24B and which is also held in position with a serrated plate 52. The fixed jaw 24 has serration on its bottom surface which mate with the plate 52. Plate 52 is T-shaped as shown in FIG. 1 and also in FIG. 10, with serrated wings 52A extending out on opposite sides of a main body 52B. The wings 52A are not centered longitudinally on body 52B. The body 52B fits down into the space or slot between the shoulders of the T-slot 11. The wings 52A rest on the bottom surface of the cross slot 12 at this location.

The serrated plate 52 is thus held in position by wings 52A against moving in direction along the longitudinal axis of the T-slot 11 in which the fixed jaw 24 is mounted. The cap screw 24A extends through slots 24C and 52C in the body of the fixed jaw 24 and the plate, so that the fixed jaw 24 can be adjusted an amount determined by the length of slot 24C along the serrated plate 52 in longitudinal direction of the T-slot. The serrations of fixed jaw 24 mating those of the plate 52 are on the bottom surface of the narrow neck portion 24D that fits into T-slot 11. This will permit adjustment of the fixed jaw 24 with the T-shaped serrated plate 52 in the position that is shown in FIG. 1 for the full extent of the slot 24C. By removing the fixed jaw 24 from the table and turning the serrated plate 52 end for end, additional adjustment toward the clamp assembly 25 can be achieved.

The movable jaws 21 and 22, as well as the wedge 15, are also protected against having chips interfere with movement, by getting underneath the wedge or the jaws. The movable jaws 21 and 22 have flanges along the sides of the clamp body 38. The flanges or skirts for the jaw 22 are shown at 22D in FIG. 7. The flanges 22D slide along the sides of the body 38, to provide for protection against entry of chips underneath the movable jaw 22. The movable jaw 21 also has flanges 21D as shown in dotted lines in FIGS. 1 and 2.

The elastomeric or resilient mountings for the retainer pins that protrude into bores in the movable jaws, including pins 34, 39 and 42 provide a spring like action that will return the respective jaw to its unlocked or rest position when the cap screws for the lock wedges are loosened. Other spring mountings can be used as long as the retainer pin yields to permit movement of the movable jaw. When cap screw 14C is loosened, the pin 34 will tend to return to the position shown in solid lines in FIG. 2 (and dashed lines in FIG. 11), which is the released or free position. The return force will move the wedge up along surface 32B and the movable jaw 32 will have to release the workpiece it is holding. Likewise, the pins 39 and 42 will return to their solid line positions shown in FIG. 2, and maintain a load on the wedge surfaces.

Figure 9:
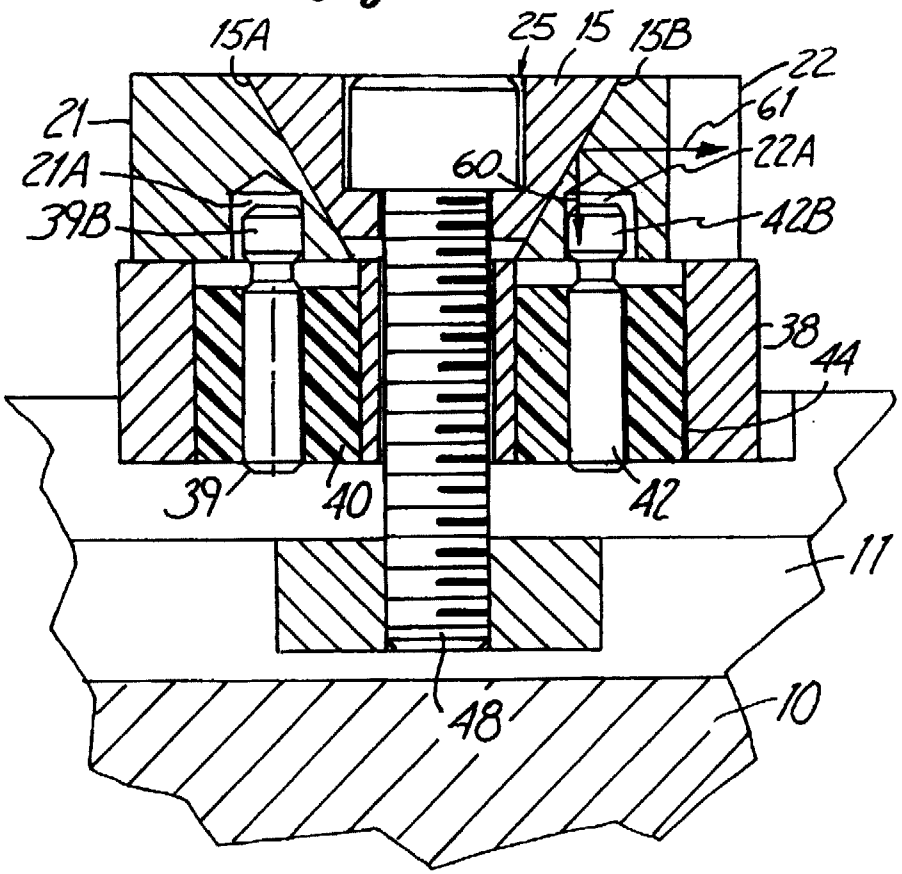
FIG. 9 is an enlarged sectional view of the double wedge clamp shown in a locked position.

The clamping position of the double lock wedge clamp is shown in FIG. 9, and it can be seen that the pins are vertical, and further clamping will cause them to incline in an opposite direction from FIG. 2, as shown for pin 34 in FIG. 11.

Figure 12:
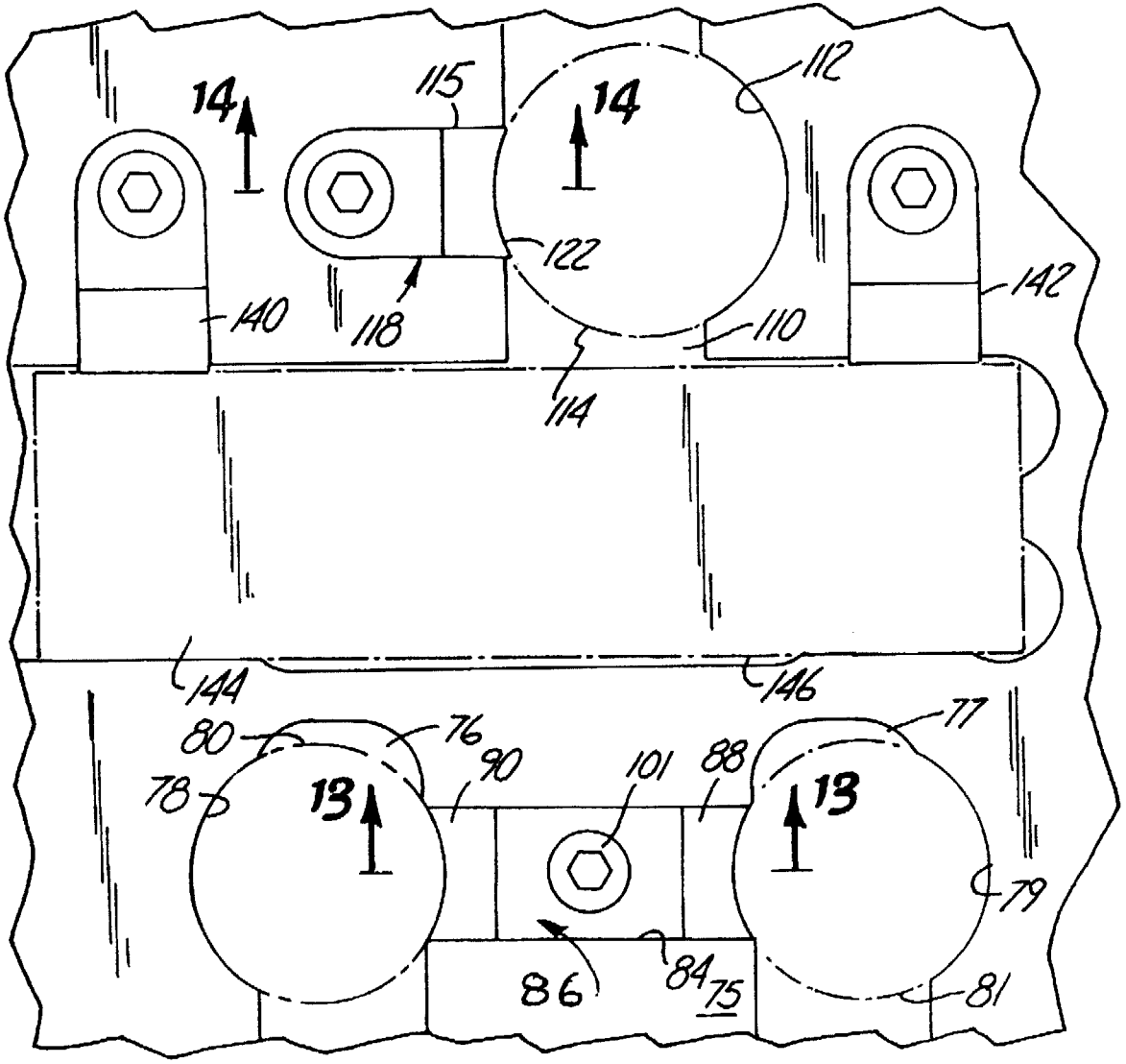
FIG. 12 is a top plan fragmentary view of a portion of a pallet having part nests therein for holding piece parts and utilizing the clamp of the present invention for clamping the parts in place.
Figure 13:
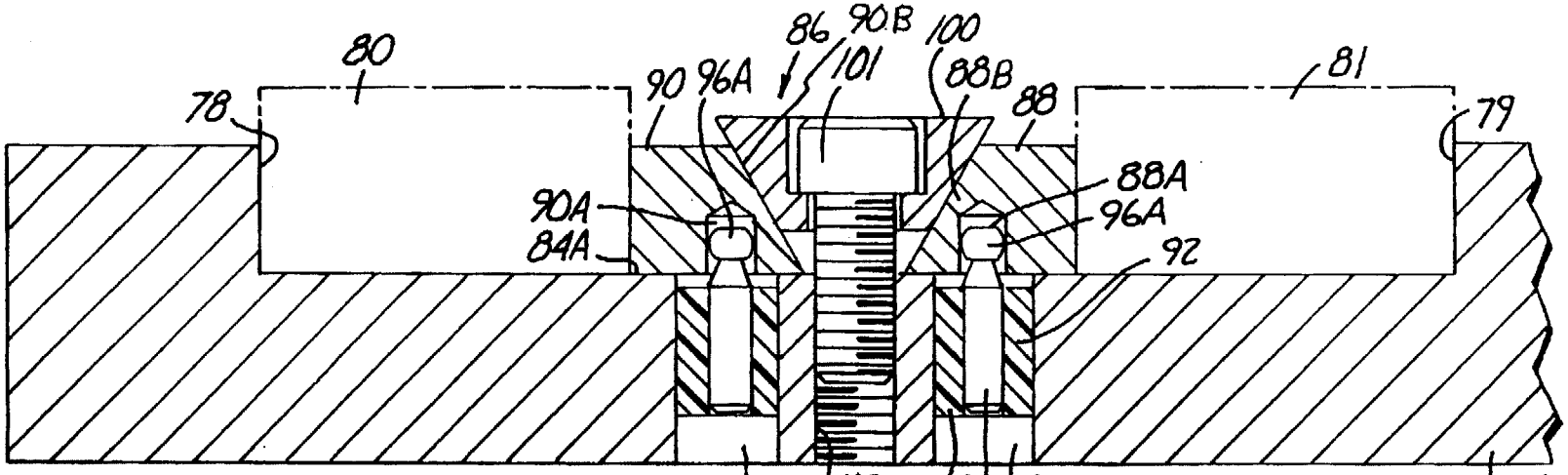
FIG. 13 is a sectional view taken as on line 13—13 in FIG. 12.
Figure 14:
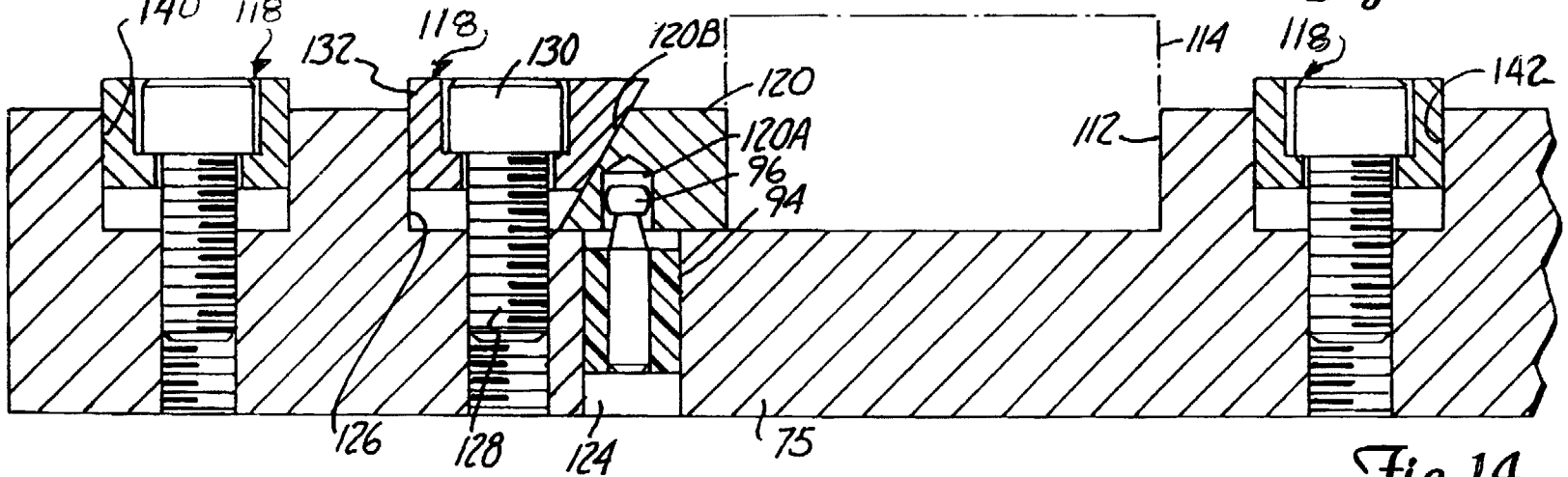
FIG. 14 is a sectional view taken as on line 14—14 in FIG. 12.

A modified form of the invention is illustrated in FIGS. 12, 13 and 14, for use with a special holder or pallet that has carved in nests for a workpiece.

Referring to FIG. 12, a pallet body or mounting block 75 is provided with various recesses therein including, for example, a pair of recesses shown at 76 and 77 that are spaced apart at a selected location, and are formed to have a pair of generally part cylindrical surfaces 78 and 79 formed therein as shoulders, to hold and receive a workpiece shown schematically at 80 and 81 in the recesses formed.

The recesses 76 and 77 are joined by a precisely machined slot 84, and as shown in FIG. 13, a wedge clamping assembly 86 is mounted in the slot. The wedge clamping assembly 86 is made according to the present invention, and as shown the slot 84 has a bottom surface 84A on which a pair of oppositely facing movable jaws 88 and 90 are mounted. The jaws 88 and 90 are provided with interior receptacles or bores 88A and 90A formed in their bottom surfaces. The pallet body 75 has a bore or receptacle 88A defined therein below the position of the jaw 88 and aligned with it. A spring and pin assembly 92 is mounted in bore 88A. The assembly 92 includes an elastomeric cylinder 94 containing a molded in pin 96. The pin 96 has a head 96A which fits into the receptacle 88A, and the resilient material 94 provides a spring load on the pin and jaw 88 as previously explained. The pin 96 will move from a free position inclined in a direction away from the workpiece 81 to a spring loaded position as the elastomeric cylinder compresses. As shown, the pin 96 is approximately midway between its limits of spring loaded travel.

The movable jaw 90 has a receptacle 90A therein, and the body has a bore 98 that receives a spring and pin assembly 92 that is formed as previously explained, with a pin 96 in place, and a pin head 96A in the bore 90A. It should be noted that the pin head shape is slightly different in FIGS. 12–14, than in the earlier form of the invention. The pin heads can have various shapes and still operate satisfactorily.

The wedge members 88 and 90 have wedge surfaces 88A, 88B and 90B, respectively, that are engaged by mating surfaces of a double faced wedge 100. The double faced wedge 100 is actuated with a cap screw 101 that is threaded into a bore 102 in the body 75, and as shown the cap screw 101 passes through a provided opening in the wedge 100. When the screw 101 tightened it forces the oppositely facing wedge surfaces against the surfaces 90B and 88B to force the jaws 90 and 88 outwardly against the respective workpieces 80 and 81. Thus, the use of the elastomeric springs and the wedge clamping action can be obtained in a fixed base 75 as well as in connection with a tool table or the like, as previously illustrated.

As shown in FIGS. 12 and 14, there is an additional slot or recess 110 formed in the body 75 having a shoulder surface 112 to hold and react loads on a workpiece 114. A slot 115 is machined to one side of the slot 110 along an axis perpendicular to the central axis of the slot or recess 110. The slot 115 is on an opposite side of the recess 110 from the surface 112 and is aligned with the surface 112. The slot 115 in turn mounts a single acting wedge clamp 118, as shown in FIG. 14. The wedge clamp 118 has a movable jaw member 120 having a jaw face machined to conform to the workpiece 114. The movable jaw 120 has a receptacle or bore 120A therein.

The base or mounting block 75 has a bore 124 formed therein to receive a pin assembly 94, which is identical to the cylindrical elastomeric mounted pin assembly shown in FIG. 13. The pin 96 is inclined when at a rest position as shown in FIG. 11. A pin head 96A protrudes into the receptacle or bore 120A, to provide a spring load tending to spring load the jaw 120 away from the part 114 when the jaw is moved to clamp a workpiece.

The slot 115 has an end surface 126 which is illustrated as being part cylindrical (see FIG. 12). A threaded bore 128 is formed in body 75 and a cap screw 130 is threaded into the bore 128. The cap screw 130 passes through an opening of a wedge 132 that has a wedge surface that in turn engages a wedge surface 120B of the movable jaw 120. The axis of the screw 130 is parallel to the axis of the surface 126. The axis of the cap screw 130 is parallel to the half cylinder end surface 126, which reacts the clamping loads as the wedge is moved so that there is no bending load on the cap screw as it is tightened to force the wedge 132 downwardly against the surface 120B and cause a clamping action moving the movable jaw 120 against workpiece 114.

As shown schematically in FIG. 12, the same type of clamp shown at 118 can be mounted in slots 140 and 142 for engaging against a rectangular part 144 that is mounted in a suitably formed recess 146 in the surface of the pallet body or block 75.

Again, the slots in the pallet body 75 are closely machined so that the side surfaces of the slots protect the side surfaces of the movable jaw and the wedge from chips getting between the surfaces that have to slide relative to each other. The pins 96 will be positioned to provide a preload against the jaws 120 tending to keep the jaws tight against the wedge surface of the corresponding wedge such as the wedge 100, and 132.

In this form of the invention, the movable jaws do not require flanges for guiding and keeping chips out of the way because of the side surfaces of the slots provide a guiding action to keep the movable jaws properly guided and to prevent chip entry.

The spring loaded pins in all forms of the wedge clamps provide a substantial amount of movement under spring load between the free position and the fully loaded positions. The space required for the wedge clamps is very small.

It should thus be noted that the pallet body 75 forms a "clamp body" within the meaning of the present invention, by providing a support for slidably mounting the movable jaws and for holding the spring pins into position to provide the resilient load against the wedge surfaces.

The movable jaws will be retained on the pins unless the wedge controlling the respective jaw raises far enough so that the receptacle or bore on that jaw clears the pin head in the bore. This prevents the movable jaws from falling out during normal unclamping, but permits a quick change of the movable jaws merely by intentionally raising the respective wedge sufficiently far so that the movable jaw can be slipped off the head of its retainer pin. The pin will remain in position on the clamp body since the pins are held in place in elastomeric material. Then a new jaw can be placed on that body for clamping. Typical jaw face configurations are shown in FIG. 2, including the gentle V-shape that will hold a horizontal axis cylindrical member 18, a normal flat jaw 21, and a gentle V-shaped jaw 22 that is for holding a cylindrical member 23 with a vertical axis.

The movable jaws also can be formed with a soft material layer on the face when initially cast, so that the jaw faces can be machined with CNC machines to achieve a desired configuration for irregularly shaped workpieces for properly orienting the workpiece and clamping such workpieces in place. The jaws are quick change because the short movement of the respective wedge will permit one jaw to be removed from the clamp body, and then the next jaw to be replaced for the particular part being machined.

Automatic spring opening of the jaws is provided with the retainer pins, and a sufficient amount of travel is provided for ordinary clamping operations.

Also as shown in FIG. 9, the vectors of force shown include a downward vector on the movable jaw itself when the wedges are used, as shown at 60, as well as providing a clamping vector 61. The force downward will hold the movable jaw down against the surface of the clamp body that is supporting the jaw, and provide a well recognized, desirable clamping action.

The double lock wedge 15 will float slightly on its cap screw 48 and because the cap screw 48 used not only tightens the double lock wedge but also clamps the clamp body 38 to the T-slot. The clamp body will move on the table before tightening down if the movement required for clamping the oppositely facing movable jaws changes. The clamp is designed to be used for double clamping, and the clamp body 38 will suitably adjust along the T-slot to accommodate the size of parts being held. Clamping is accomplished with only a small amount of movable jaw movement.

The wedge angles are about 30°, as shown. The elastomeric material mounted spring pins have enough movement to retract the wedges under spring force to their starting or released positions while keeping the sliding surfaces engaged to prevent chip entry.

Although the present invention has been described with reference to preferred embodiments, workers skilled in the art will recognize that changes may be made in form and detail without departing from the spirit and scope of the invention.

What is claimed is:

1. A wedge clamp comprising a clamp body, a movable jaw mounted on the body, and a wedge-movable in a first direction and having a surface operable for creating a force for moving the movable jaw in a second clamping direction from an unclamped position along the clamp body, the body having a bore, a pin mounted in the bore of the clamp body, and a resilient material surrounding the pin in the bore to provide a spring force for permitting the pin to be resiliently movable, and a receptacle in the movable jaw for receiving a portion of the pin protruding into the receptacle, said portion of the pin received in the receptacle being resiliently movable in the second direction when the movable jaw is moved in the second direction from the unclamped position, thereby tending to move the movable jaw to an unclamped position as the pin is resiliently moved in the second direction.

2. The wedge clamp of claim 1, wherein the wedge surface engages a mating surface on the movable jaw, the wedge surface overlying the mating surface relative to the clamp body, and wherein the pin protrudes into the receptacle sufficiently far so that the movable jaw is retained on the clamp body until the wedge is moved in opposite direction from the first direction a selected distance after the movable jaw is unclamped, and then the movable jaw can be removed from the pin.

3. The wedge clamp of claim 1, wherein the resilient material comprises an elastomeric material surrounding the pin and retaining the pin relative to the clamp body.

4. The wedge lock clamp of claim 3, wherein the elastomeric material mounts the pin with an axis of the pin inclined from a plane parallel to the first direction and perpendicular to the second direction in a rest position.

5. The wedge clamp of claim 1, wherein the clamp body has two movable jaws mounted thereon and the wedge has surfaces for simultaneously operating both movable jaws.

6. The wedge clamp of claim 1, the wedge surface directly engaging a mating surface on the movable jaw and inclined to overlie the mating surface, the movable jaw thus being urged under a force component parallel to the first direction as the movable jaw is moved in the second direction.

7. The wedge clamp of claim 6, the clamp body having a planar support surface on which the movable jaw slides, the wedge being moved toward the support surface as the wedge moves in the first direction and a reaction surface perpendicular to the support surface and parallel to the first direction for engaging a portion of the wedge to react loads on the wedge.

8. The wedge clamp of claim 1, wherein the clamp body has side surfaces, and a support surface extending between the side surfaces for supporting the movable jaw, the movable jaw having flanges that fit along the side surface to shield the support surface.

9. The wedge clamp of claim 1 wherein the clamp body comprises a body having receptacles for receiving workpieces therein, and a slot in the clamp body for receiving and guiding the movable jaw and wedge.

10. A clamp comprising a clamp body having a planar support surface, a movable jaw mounted on the clamp body for sliding movement along the support surface, and a member movable relative to the clamp body for creating a force for moving the movable jaw in a direction along the support surface of the clamp body for clamping, a pin mounted on the clamp body and protruding beyond the support surface, and a receptacle in the movable jaw for receiving a head of the pin protruding beyond the support surface, said pin being resiliently movable from a rest position in the direction of movement of the movable jaw when the movable jaw is moved by the member movable for creating a force.

11. The clamp of claim 10, wherein the member movable relative to the clamp body comprises a wedge movable in a first direction toward the support surface, the wedge having a wedge surface inclined relative to and facing toward the support surface and overlying and movable to engage a mating inclined surface on the movable jaw for creating the force for moving the movable jaw, the direction of movement of the movable jaw being a second direction, and wherein the receptacle in the movable jaw is a bore closely fitting the head of the pin and wherein the head of the pin protrudes into the receptacle sufficiently far so that the movable jaw is retained on the head of the pin by the overlying wedge surface until the wedge has moved in opposite direction from the first direction a selected distance.

12. The clamp of claim 10, wherein said pin is retained in a bore in the clamp body with a resilient material to provide a spring force tending to retain the movable jaw to position with the pin in its rest position.

13. The clamp of claim 12, wherein the resilient material comprises an elastomeric material surrounding the pin and retaining the pin relative to the clamp body.

14. The clamp of claim 11, wherein the clamp body has side surfaces, the support surface extending between the side surfaces, the movable jaw and the wedge both having flanges that overlap the side surfaces.

15. The clamp of claim 12, wherein the wedge and movable jaw are mounted in a slot in the clamp body, the slot having side surfaces for slidably guiding the movable jaw and wedge and fitting closely along the sides of the movable jaw and wedge to protocol from entry of chips into the slot.

16. A vise for use on a tooling plate having T-slots thereon for mounting a first movable jaw and a second fixed jaw, the movable jaw surface facing the fixed jaw, the table further having cross slots perpendicular to a length of the T-slots, a securing member for the fixed jaw comprising a serrated surface plate which has a main body fitting into an opening of the T-slot, and wings on opposite sides of the main body that fit in the cross slot, the wings being closer to a first end of the main body than to a second end to provide different lengths of extension of the main body in a direction along the T-slot from the cross slot when the main body is reversed in position.

17. A wedge clamp comprising a clamp body, a movable jaw mounted on the body, and a wedge movable in a first direction and having a surface operable for creating a force for moving the movable jaw in a second clamping direction from an unclamped position to a clamping position along the clamp body, a pin mounted on the clamp body, a receptacle in the movable jaw for receiving a portion of the pin protruding into the receptacle, said portion of the pin received in the receptacle being resiliently movable in the second direction when the movable jaw is moved in the second direction from the unclamped position, and a cap screw threaded into the clamp body and having a screw axis parallel to the first direction and being threaded for moving the wedge in the first direction, the wedge having an end surface opposite the wedge surface, and the clamp body having a reaction surface which is engaged by the wedge end surface, the reaction surface being substantially parallel to the screw axis.

18. A wedge clamp comprising a clamp body;

a movable jaw mounted on the clamp body;

a wedge movable in a first direction on the clamp body and having a surface operable for creating a force for moving the movable jaw in a second direction along the clamp body from an unclamped position to a clamped position, the clamp body having a movable jaw support surface extending between a pair of spaced side surfaces, both of the side surfaces being substantially parallel to the second direction;

the wedge being spaced from the support surface with the movable jaw in an unclamped position and the wedge surface engaging the movable jaw, the wedge being movable toward the support surface for moving the movable jaw toward the clamped position;

the wedge having a pair of depending flanges slidably mounted on the clamp body and overlapping portions of the side surfaces to shield a space between the support surface and the wedge;

the depending flanges slidably guiding the wedge as the wedge is moved to create the force moving the movable jaw toward a clamped position; and a resilient spring member for urging the movable jaw actuator surface in direction to engage the wedge surface.

19. The wedge clamp of claim 1, wherein the receptacle has an axis generally perpendicular to the second direction, and wherein the pin is inclined relative to the receptacle axis in a direction opposite from the second direction, to increase the distance that the portion of the pin can be moved as the movable jaw is moved to a clamping position.

20. A clamp member having a clamp body and a movable jaw slidable on the clamp body;

the clamp body having generally parallel, spaced side surfaces extending parallel to a direction of slidable movement of the movable jaw;

a support surface on the clamp body for the movable jaw extending between the side surfaces, the movable jaw having a surface inclined relative to the direction of slidable movement of the movable jaw; and a wedge member having a wedge surface engaging the inclined surface of the movable jaw, said wedge member being movable toward the support surface from a first position to provide a force tending to slidably move the movable jaw to a clamping position, said wedge member having a pair of spaced apart flanges overlapping the side surfaces of the clamp body when the wedge member is in its first position to slidably guide the wedge member and to shield a space between the wedge member and the clamp body as the wedge member is moved toward the support surface to slidably move the movable jaw.

21. The clamp member of claim 20, wherein the movable jaw has a pair of depending flanges that fit over and are slidable along the side surfaces of the clamp body to shield the support surface in portions supporting the movable jaw and to slidably guide the movable jaw on the clamp body when the movable jaw is supported on the support surface.

* * * * *